US011047645B2

(12) United States Patent
Berean

(10) Patent No.: US 11,047,645 B2
(45) Date of Patent: Jun. 29, 2021

(54) FIREARM SIGHTING APPARATUS HAVING INCREASED FIELD OF VIEW

(71) Applicant: Vincent Tactical, Inc., Chittenango, NY (US)

(72) Inventor: Kyle J. Berean, Chittenango, NY (US)

(73) Assignee: VINCENT TACTICAL, INC., Chittenango, NY (US)

( * ) Notice: Subject to any disclaimer, the term of this patent is extended or adjusted under 35 U.S.C. 154(b) by 0 days.

(21) Appl. No.: 16/853,741

(22) Filed: Apr. 20, 2020

(65) Prior Publication Data

US 2020/0333108 A1 Oct. 22, 2020

Related U.S. Application Data

(60) Provisional application No. 62/835,516, filed on Apr. 18, 2019.

(51) Int. Cl.
*F41G 1/01* (2006.01)
*F41G 1/12* (2006.01)

(52) U.S. Cl.
CPC *F41G 1/01* (2013.01); *F41G 1/12* (2013.01)

(58) Field of Classification Search
CPC ..... F41G 1/01
USPC ..... 42/130–133, 144
See application file for complete search history.

(56) References Cited

U.S. PATENT DOCUMENTS 4,130,958 A * 12/1978 Gutridge ..... F41G 1/02 42/144
5,327,654 A * 7/1994 Parker ..... F41G 1/01 42/136
6,360,471 B1 * 3/2002 Stein ..... F41G 1/01 42/122
2020/0106201 A1 * 4/2020 Herring ..... H01R 12/78

* cited by examiner

*Primary Examiner* — Reginald S Tillman, Jr.
(74) *Attorney, Agent, or Firm* — Barry F. Manna

(57) ABSTRACT

A sighting apparatus for a firearm includes a front sight affixed to an upper surface at a front end of the firearm, and a rear sight affixed to the upper surface at an opposing rear end of the firearm. The rear sight includes a main body and an indexing element positioned thereon. The indexing element has its terminus aligned with the top surface of the rear sight body. The front sight is positioned higher than the rear sight, such that aiming the firearm involves pointing the front sight at the target, then aligning the bottom of the front site with the upper terminus of the indexing element on the rear sight. In one embodiment of the invention, the rear sight has a low-profile that enables the user to regain significant field of view that was blocked by prior art rear sights.

9 Claims, 10 Drawing Sheets

FIREARM SIGHTING APPARATUS HAVING INCREASED FIELD OF VIEW

CROSS REFERENCE TO RELATED APPLICATION

Reference is made to and this application claims priority from and the benefit of U.S. Provisional Application Ser. No. 62/835,516, filed Apr. 18, 2019, entitled "SIGHTING APPARATUS HAVING INCREASED FIELD OF VIEW," which application is incorporated herein in its entirety by reference.

BACKGROUND OF THE INVENTION

Firearm sighting devices permit firearm users to reliably align a firearm accurately relative to a target such that a projectile fired from the firearm may hit the target. Such sighting devices generally fall into two groups: active sights and passive sights. Active sights require an electrical power source, illuminating the target with some form of radiation, such as a laser beam. Passive sights typically rely on ambient illumination of the target. One common example of a passive sight is an open sight or iron sight. An iron sight generally includes a front sight secured to the front end of the barrel, and a rear sight secured at the rear end of the receiver or slide. A typical front sight may include a post, blade, bead, or tang aligned along the barrel axis, and may be painted a highly contrasting color such as white, red, orange. A typical rear sight may include a complementary notch, groove, or circular aperture.

The process of aiming the firearm at a target involves pointing the front sight at the target, then aligning the front sight within the notch, groove, or circular aperture of the rear sight. This process inevitably involves, perhaps unintentionally, focusing on the target, the front sight, and the rear sight. Since the human eye can only focus on a single distance at a time, iron sight users may find the front sight tends to wander as the user shifts focus.

SUMMARY OF THE INVENTION

The subject matter of this disclosure relates generally to firearm sighting systems. Of particular interest herein is a pistol sighting apparatus comprising a front sight and a rear sight. The rear site includes an indexing element having its terminus aligned with the top surface of the rear sight body. The front sight is physically positioned higher than the rear sight. The aiming process involves pointing the front sight at the target, then aligning the bottom of the front site with the upper terminus of the indexing element on the rear sight.

In one embodiment of the invention, the rear sight has a low-profile that enables the user to regain significant field of view that was blocked by prior art rear sights.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
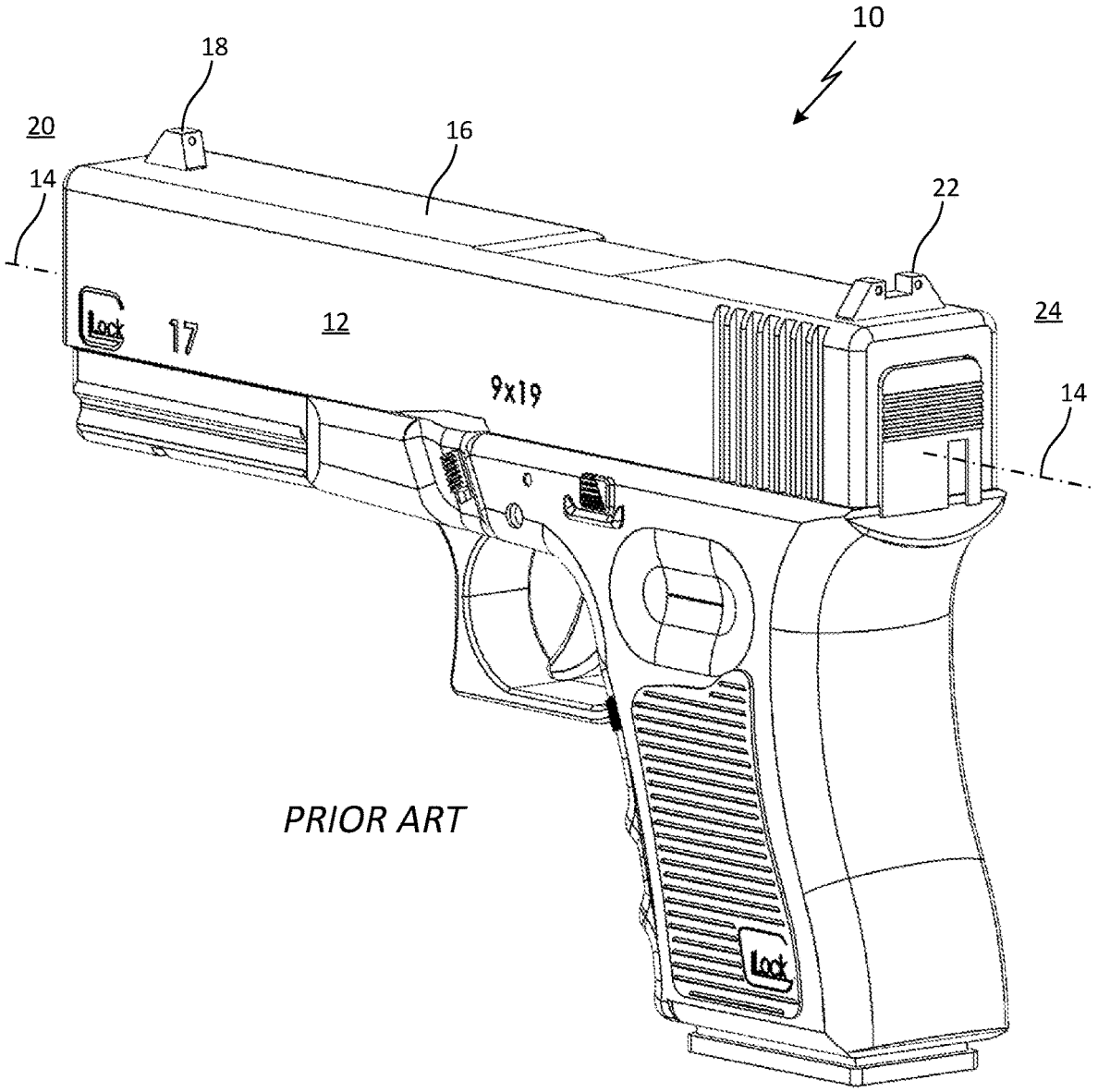
FIG. 1 depicts a rear perspective view of a firearm with a conventional prior art three-dot iron sight.

FIG. 1 depicts a prior art firearm 10, such as a Glock Model 17 pistol. The firearm 10 may include a slide 12 that moves from front-to-rear along a barrel centerline 14 when the pistol discharges a round of ammunition. The slide 12 generally retains the firing pin/striker and the extractor, and serves as the bolt. The slide 12 is spring-loaded so that once it has moved to its rearmost position in the firing cycle, spring tension returns it to its initial position while chambering a new round. A sighting apparatus is secured to the slide 12 on an upper surface 16 thereof. The sighting apparatus includes a front sight 18 affixed at a front end 20 of the firearm (e.g., the barrel discharge), and a rear sight 22 affixed at an opposing rear end 24 of slide 12.

Sight alignment and focus are challenging with an iron sight. To aim with an iron sight, the user first aligns the front and rear sights with each other, then focuses the front sight on the target. For a center hold, the front sight is positioned on the center of the target, bisecting the target vertically and horizontally. For a 6 o'clock hold, the front sight is positioned just below the target and centered horizontally. At the instant the trigger is pulled, focus should be on the front sight, with only enough view of the rear sight to assure the front sight is properly aligned in it.

To align the front and rear sights, the front sight blade, post, or bead is positioned both vertically and horizontally in the center of the rear sight notch. However, the human eye can only focus on one distance at a time—it cannot simultaneously focus on the target, the front sight, and the rear sight. As a result, aligning the front and rear sights often leads to "hunting" or "tracking," wherein the user drifts the front sight up and down, left and right in an effort to index it to the notch of the rear sight. This wandering wastes valuable time acquiring the target, especially in competitive or tactical situations.

One noted problem with typical iron sights is that they can obstruct the user's field of view below and to either side of the target. In some circumstances, such as competitive target shooting, the iron sight can partially block the target, making target acquisition difficult. In other circumstances, such as a tactical situation with an armed individual at a distance (for example, a 'hostile' at 25 yards), the iron sight may block the lower torso and arms of the hostile, such that the user is unable to ascertain whether the individual is drawing a weapon. The greater the distance to target, the more the target may be obstructed.

Embodiments of the present invention alleviate the noted deficiencies found in conventional iron sights. The disclosed firearm sighting apparatus reduces the physical size of the rear sight to improve a user's field of view. The lower-profile rear sight is both narrower in width and shorter in height than typical iron sights, such a three-dot sight. Additionally, the novel geometry of the rear sight allows more rapid and accurate indexing to the front sight.

Figure 2:
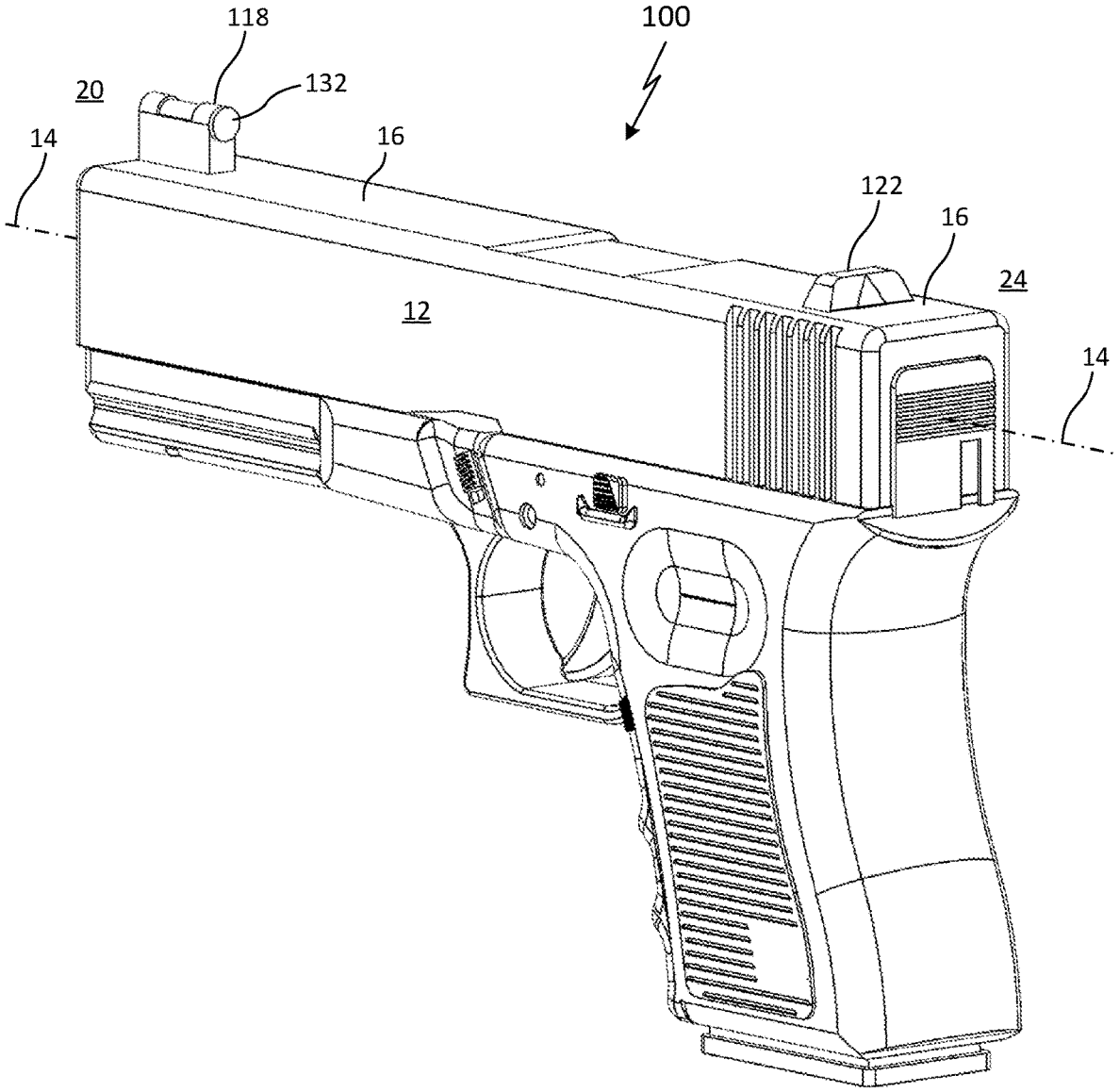
FIG. 2 depicts a rear perspective view of a firearm sighting apparatus according to one embodiment of the invention.

Turning to FIG. 2, wherein like element numbers indicate like parts from FIG. 1, a firearm 100 may include many of the same features as that shown in FIG. 1. According to embodiments of the present invention, the firearm 100 includes a sighting apparatus 126 (FIG. 5) comprising a front sight 118 affixed to the upper surface 16 the slide 12 at the front end 20 of the firearm, and a rear sight 122 affixed to the upper surface the slide at the rear end 24. Both the front sight 118 and the rear sight 122 are vertically aligned with the barrel centerline 14.

Figure 3:
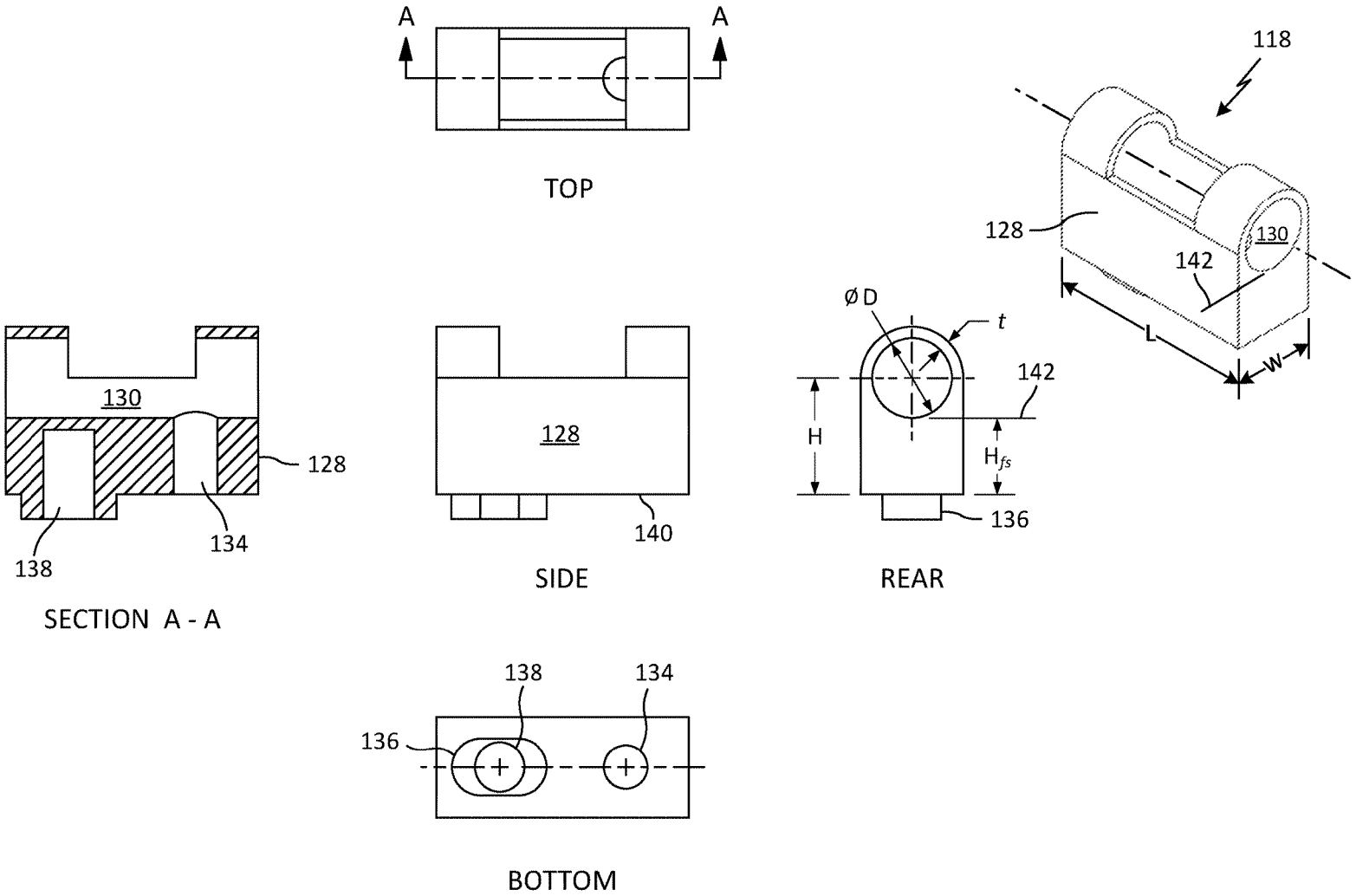
FIG. 3 depicts side, rear, top, bottom, sectional, and perspective views of the front sight shown in FIG. 2.

FIG. 3 illustrates one embodiment of the front sight 118 in engineering drawing format. In the illustrated embodiment, the front sight 118 may include a body 128 defining a cylindrical hollow 130 that holds a fiber optic rod 132. The fiber optic rod 132 is aligned with the barrel centerline 14 to provide natural illumination and thus visual contrast with the rear sight 122 and the user's environmental surroundings, enabling the user to index the rear sight more rapidly. The body 128 may further define a tapped thru-hole 134 to permit a set screw (not shown) to secure the fiber optic rod 132 into the body before the body is secured to the firearm 100.

The body 128 of the front sight 118 may be secured to the upper surface 16 of the slide 12 at the front end 20 of the firearm 100. The method by which the front sight 118 is affixed to the slide 12 may be conventional. For example, the front sight body 128 may include a raised boss 136 sized and adapted to fit within a mating aperture in the slide 12 (not shown). The boss 136 may define a drill and tapped hole 138 so that a threaded fastener may be passed upwards through the hole in the disassembled slide 12, and then the front sight body 128 may be threaded onto the fastener. In other embodiments, the front sight body 128 may include a dovetail feature, and secure to the slide 12 by way of a broach slot oriented transverse to the barrel centerline 14.

In one example particularly suitable for the illustrated Glock Model 17 pistol, the front sight body 128 may be constructed of black nylon or steel, with dimensions of 0.50 inches in length (L), 0.20 inches in width (W), and 0.23 inches in height (H) to the centerline of the hollow 130. The hollow 130 may be 0.16 inches in diameter (D), leaving approximately 0.020 inches of wall thickness (t). As a result, the front sight height ($H_{fs}$) from the base 140 of the front sight body 128 to the bottommost portion 142 of the hollow is 0.150 inches.

The relatively large diameter of the hollow 130 accommodates a larger diameter fluorescent fiber rod or fiber optic rod 132 for easier and more effective target sighting. As will be explained below, the geometry and arrangement of the disclosed sights 118, 122 affords an expanded field of view, so the front sight 118 can be considerably larger without obstructing the target view. For example, the front sight 118 can accommodate fiber rod diameters from 3 millimeters (0.120 inches) to 0.150 inches. The top of the body 128 is open to allow the fiber optic rod 132 to gather ambient light. The hole 138 in boss 136 may incorporate a #3-56 tap size, and the thru-hole 134 may incorporate a #2-56 tap size.

Other dimensions are envisioned without departing from the scope of the invention, for example the front sight 118 may be adapted for use with other models of hand guns or shotguns.

Figure 4:
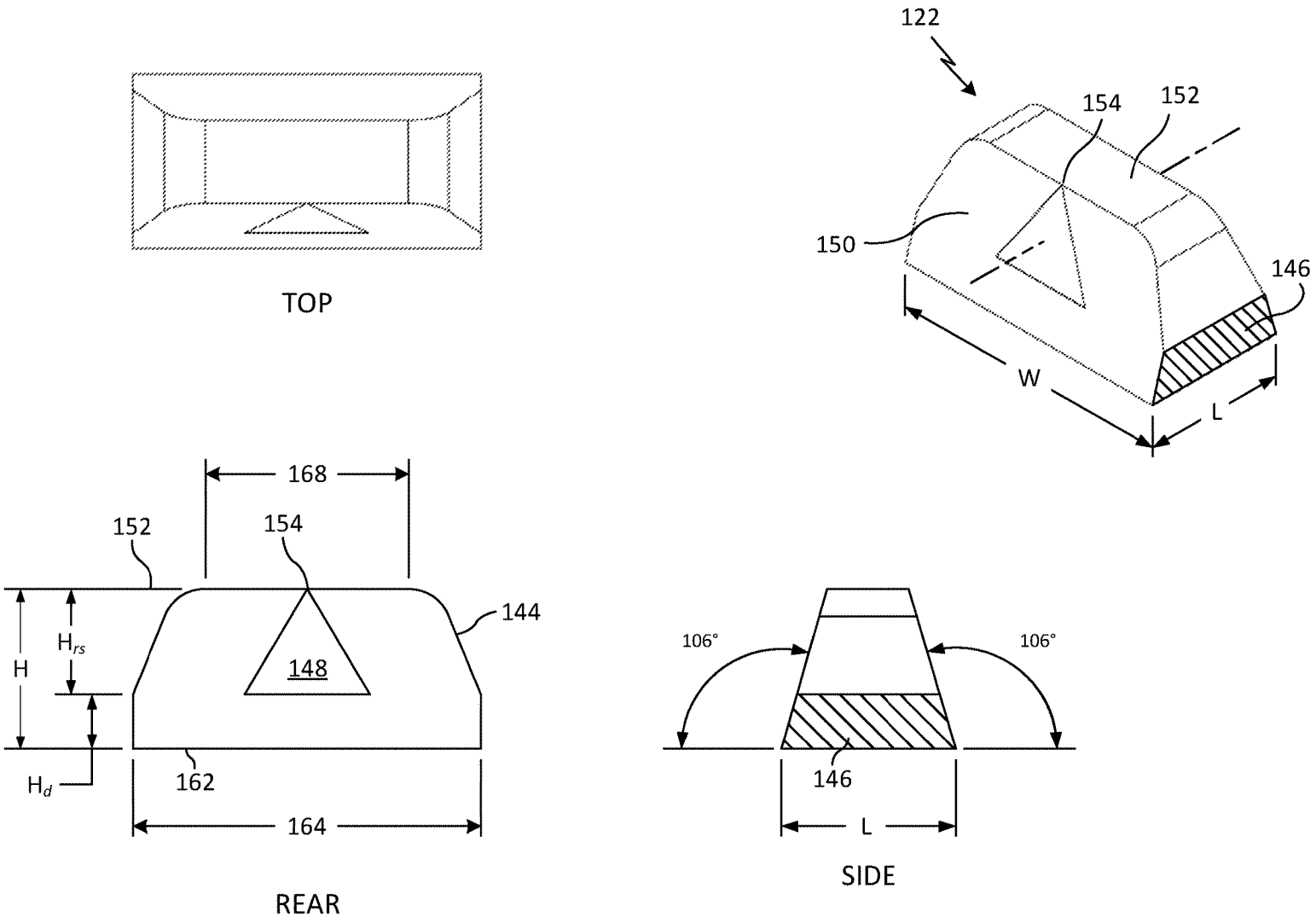
FIG. 4 depicts side, rear, top, and perspective views of the rear sight shown in FIG. 2.

FIG. 4 illustrates one embodiment of the rear sight 122 in engineering drawing format. In the illustrated embodiment, the rear sight 122 may include a main body 144 adapted to secure to the upper surface 16 of the slide 12 at the rear end 22. A lower portion of the main body 144 may form a dovetail 146, characterized by an increasing cross-sectional area in the vertical direction. In the illustrated embodiment, the dovetail 146 forms a trapezoidal cross-sectional area oriented transverse relative to the barrel centerline 14. The slide 12 includes a complimentary open broach slot (not shown), also transversely-oriented, to accept the main body 144 via sliding motion. Once in place, the trapezoidal geometry prevents the main body 144 from becoming dislodged from the slot.

The rear sight 122 further includes an indexing element 148 positioned on a rear face 150 of the main body 144. In the illustrated embodiment, the indexing element 148 comprises a white triangle, which provides a stark visual contrast to the dark-colored main body 144. The triangle's peak terminates at an upper plane 152 of the main body 144. Stated differently, the topmost portion 154 of the indexing element 148 does not protrude or extend above the upper plane 152 and, ideally, is at the same height from the upper surface 16 of the slide 12 as the upper plane 152 of the main body 144.

The shape or form of the indexing element 148 can be almost any configuration suited to the user, so long as it is positioned such that the topmost portion 154 thereof aligns with the upper plane 152, and provides a visual contrast to the rear face 150. Some exemplary configurations that have been successfully demonstrated include an arrow (pointing up), a square, and a circle. The shape or form of the indexing element 148 may also be achieved by removing material from main body 144, such that it defines an aperture in the desired shape.

In one example particularly suitable for the illustrated Glock Model 17 pistol, the rear sight body 144 may be constructed of black nylon or steel, with dimensions of 0.25 inches in length (L), 0.50 inches in width (W), and 0.229 inches in height (H). The height ($H_d$) of the dovetail portion 146 may be 0.079. As a result, the rear sight height ($H_{rs}$) from the top of the dovetail portion 146 (corresponding to slide upper surface 16) to the upper plane 152 is also 0.150 inches. Thus, in one embodiment, the upper plane 152 of the main body 144 (and topmost portion 154 of the indexing element 148) are the same height from the slide as the bottommost portion 142 of the rear sight 122.

Figure 5:
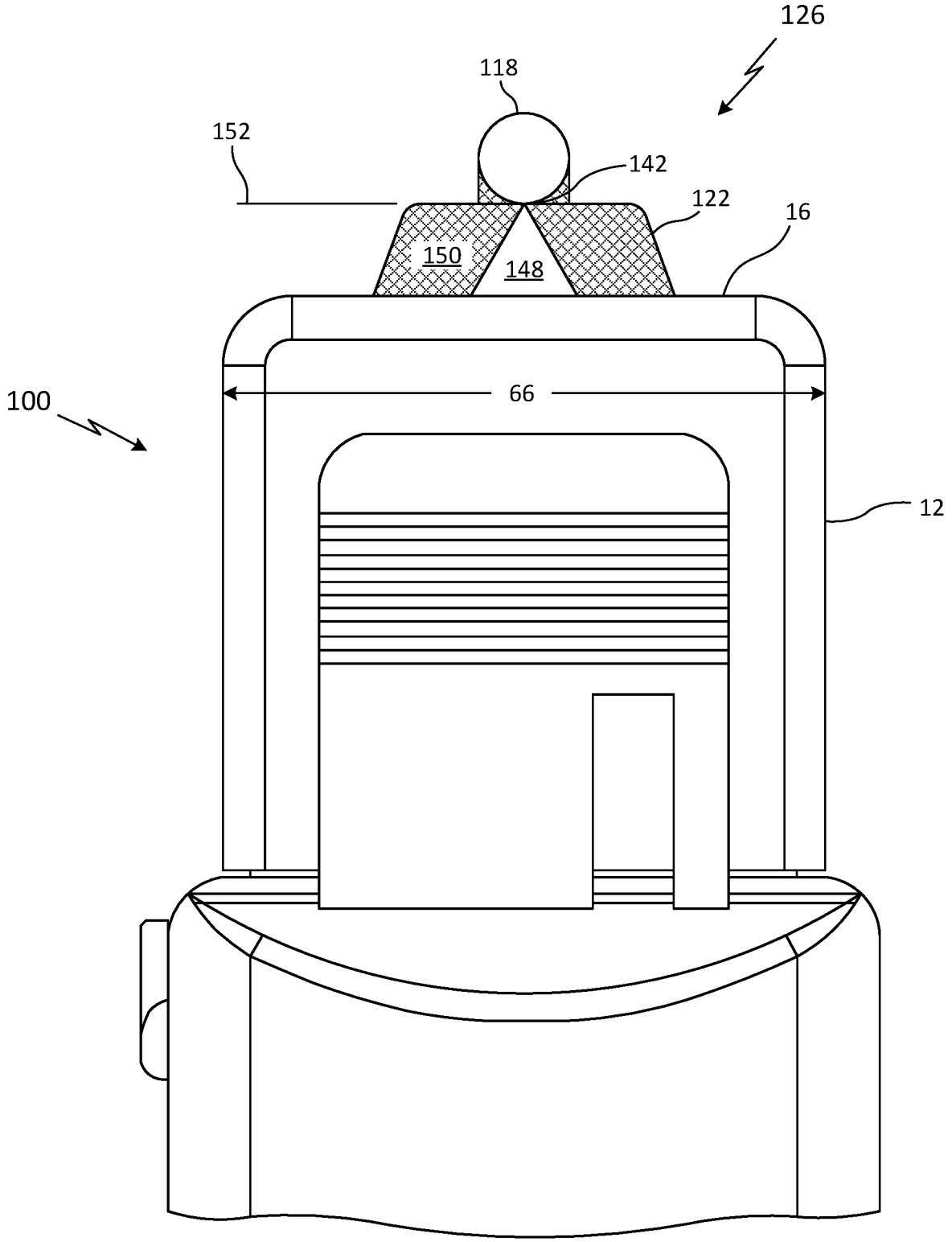
FIG. 5 depicts a rear plan view of the sighting apparatus shown in FIG. 2.

FIG. 5 illustrates the sighting apparatus 126 as viewed by a user, from the rear end 24 towards the front end 20, when aiming the firearm 100. The view depicted is a perfectly aimed pistol with the front and rear sights 118, 122 in ideal alignment. The front sight 118 is positioned on the upper surface 16 of the slide 12 at a height greater than the rear sight 122, such that the lowest point on the front sight 118 is approximately the same height as the topmost portion 154 (FIG. 4) of the indexing element 148. In other words, the bottommost portion 142 of the front sight 118 is approximately the same height from the slide upper surface 16 as the topmost portion 154 of the indexing element 148, which is also approximately the same height as the upper plane 152 of the rear sight main body 144.

To align the front and rear sights 118, 122 while aiming at a target, the user centers the front sight 118 on the target, then visually 'drops' the front sight 118 onto the topmost portion 154 of the indexing element 148. At the moment the two sights line up, the user pulls the trigger for a perfect shot.

The type, configuration, or geometry of the front sight 118 may be any style that the user finds beneficial, so long as it is positioned such that the bottommost portion 142 is approximately the same height from the slide upper surface 16 as the topmost portion 154 of the indexing element 148. For example, in addition to the round fiber optic rod 132 disclosed hereinabove, the front sight 118 may be a brightly painted post, blade, bead, or tang having a flat surface, an arrow shape, or a triangular shape, to name a few.

Likewise, the shape or form of the rear sight indexing element 148 may be any configuration or style that the user finds beneficial, so long as it is positioned such that the topmost portion 154 of the indexing element 148 is approximately the same height from the slide upper surface 16 as the bottommost portion 142 of the front sight 118. Some exemplary configurations that have been successfully demonstrated, in addition to the disclosed triangle, include an arrow (pointing down), a square, a circle, and a standard blade.

Figure 6:
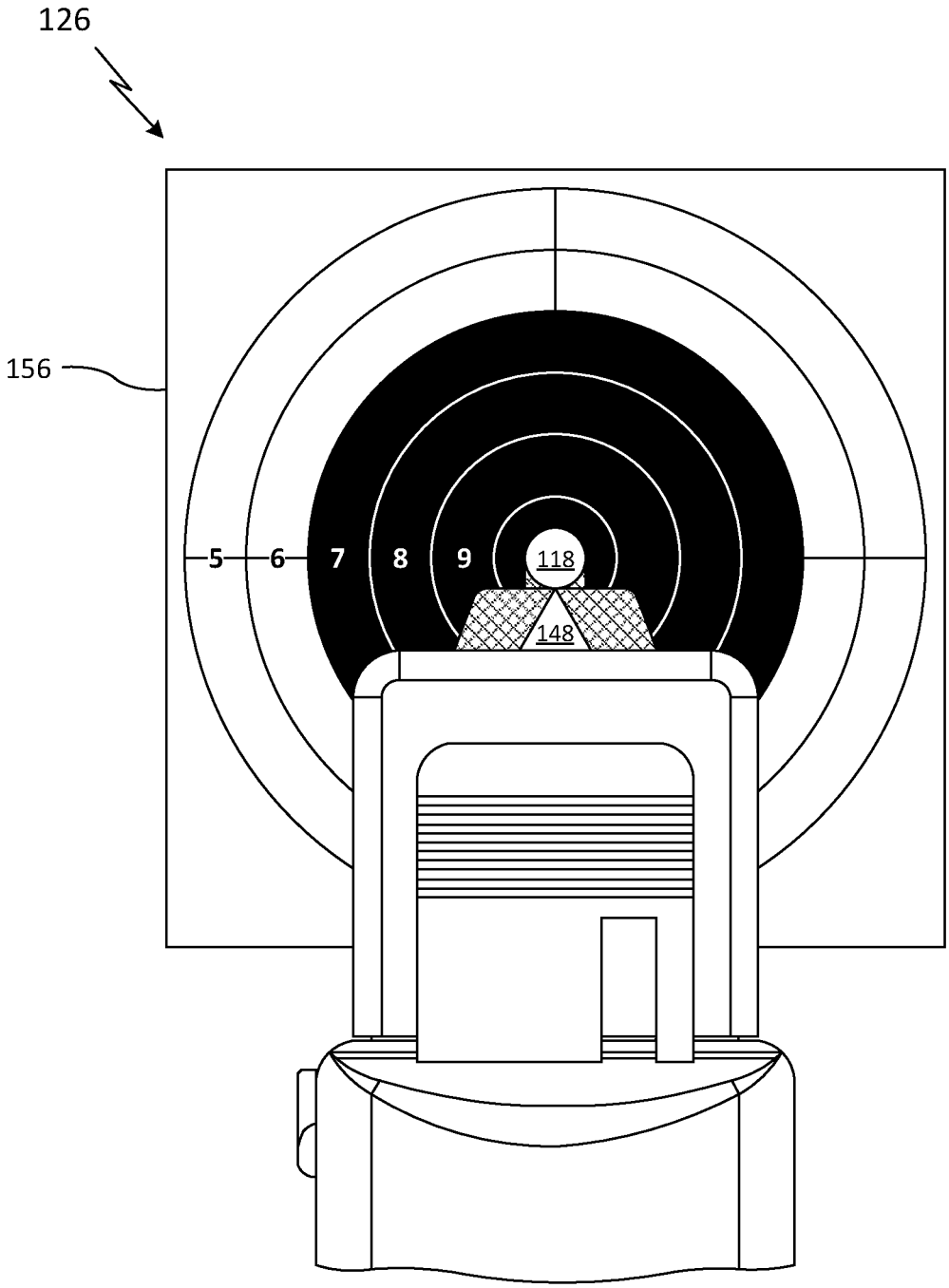
FIG. 6 depicts a rear plan view of the firearm and sighting apparatus aimed at a target.

FIG. 6 illustrates the sighting apparatus 126 as viewed by a user aiming at a target 156 approximately ten feet away. In operation, the user centers the front sight 118 on the target 156, vertically aligns the two sights 118, 122, then visually "drops" the ball 118 onto the indexing element 148 as illustrated, then takes the shot. The wasteful 'hunting' phenomenon is eliminated because the front sight 118 is above the rear sight 122 and the user only needs to see enough of the rear sight to make sure it is in proper alignment. Since there is no need to focus on the rear sight 122 while aiming, precious time is not wasted trying to align the front sight into a rectangular area. Alignment can be accomplished quite rapidly, if not dynamically, by taking the shot the instant the ball 118 drops onto the indexing element 148.

Figure 7:
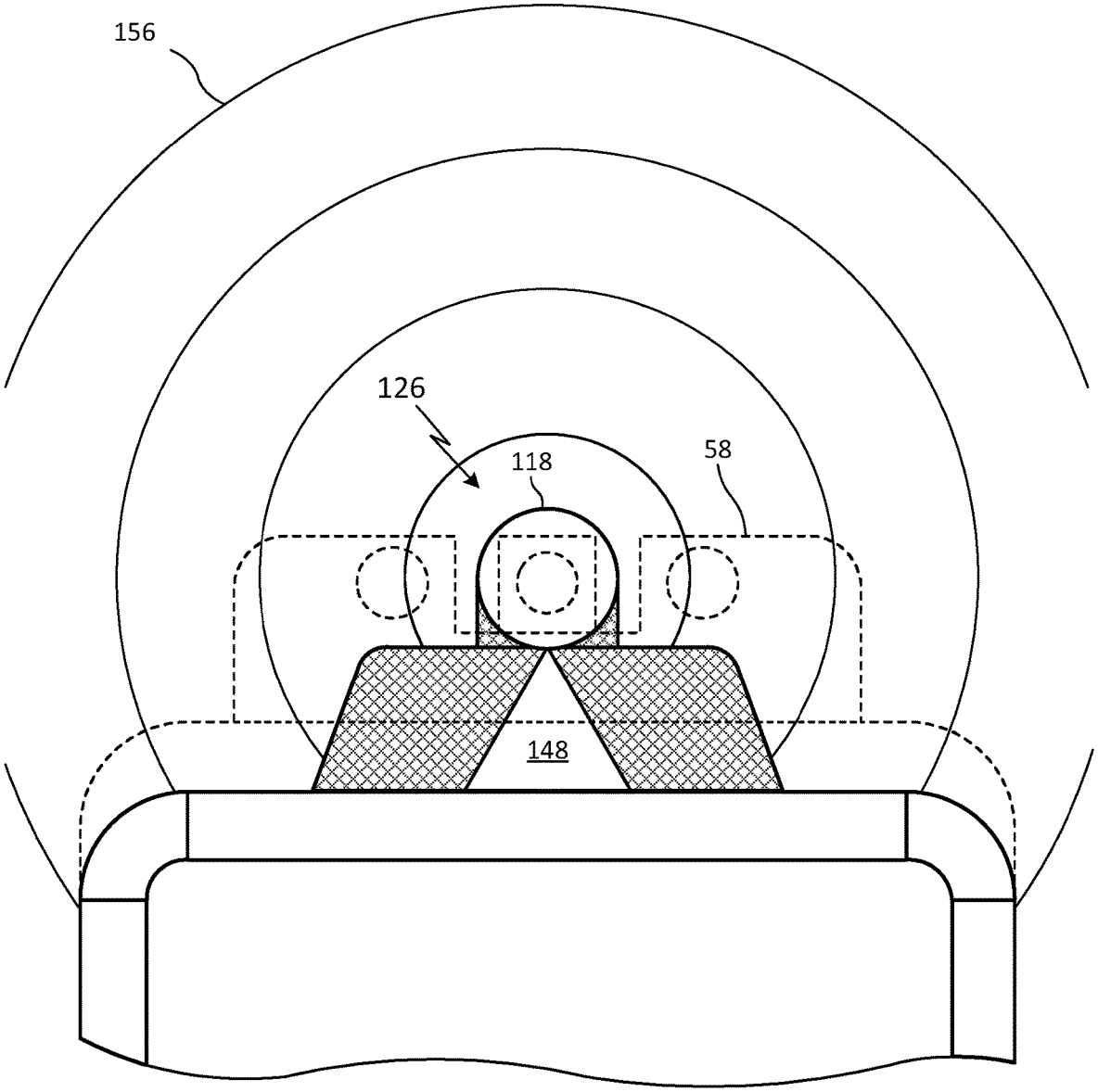
FIG. 7 depicts an enlarged view of the sighting apparatus and target of FIG. 6, overlaid with the three-dot iron sight of FIG. 1.

The disclosed sighting arrangement is a departure from conventional iron sight systems. The low profile, reduced-width rear sight 122 expands the user's field of view, giving the user increased visual acuity and greater situational awareness. By way of comparison, FIG. 7 illustrates the sighting apparatus 126 and target 156 shown in FIG. 6, overlaid with a conventional three-dot iron sight 58 (shown in dashed line), centered on the same target. Note the degree to which the three-dot iron sight 58 obscures the user's view of the target compared to the disclosed sighting apparatus 126. Also note how the front sight 118 can be sized much larger for ease of sighting, without obstructing the target view.

Figure 8:
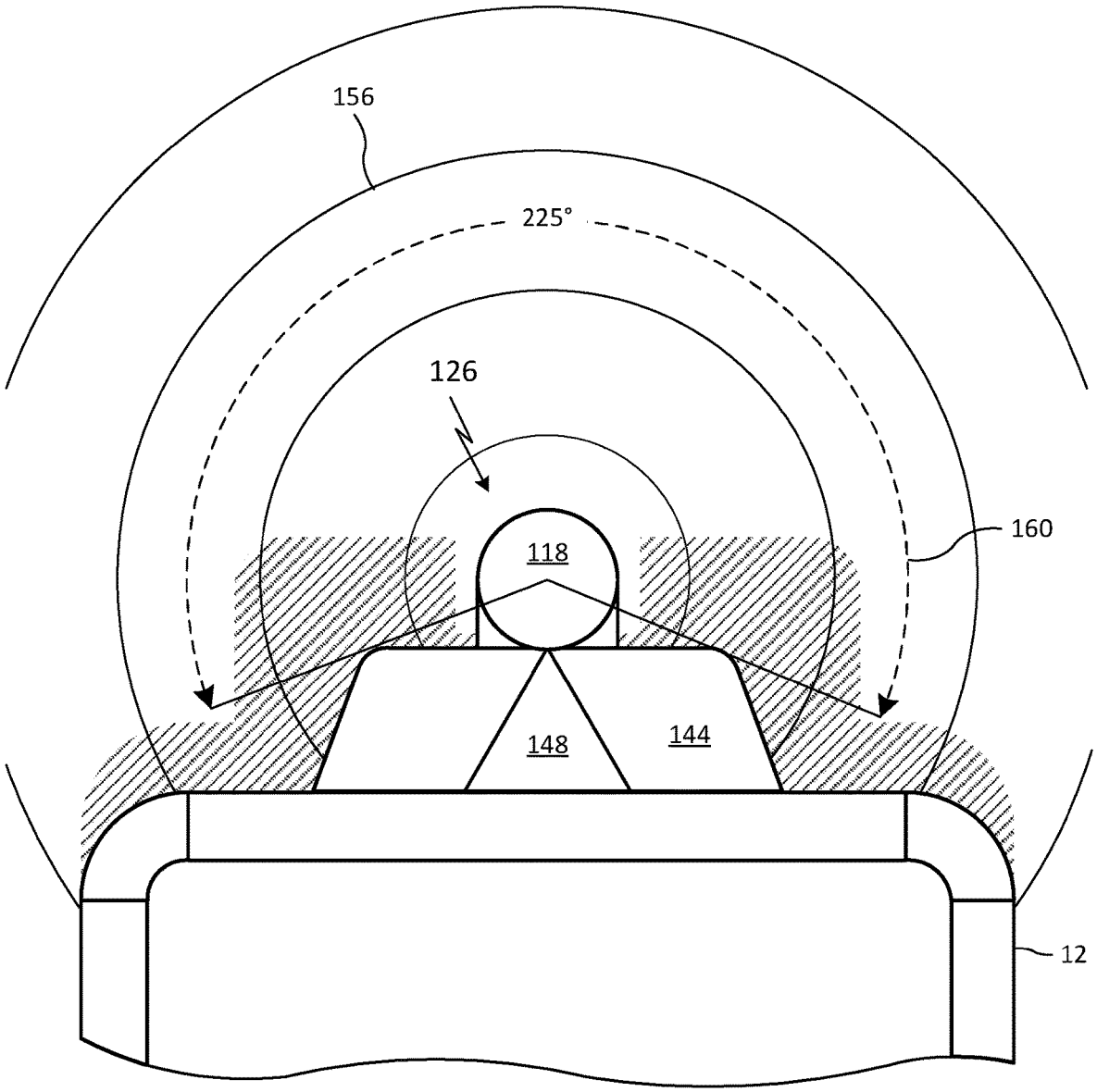
FIG. 8 depicts the sighting apparatus and target of FIG. 7, with the shaded region depicting the obstructed field of view from the three-dot iron sight.

This comparison is better illustrated in FIG. 8, where the shaded region depicts the obstructed view from the three-dot iron sight relative to the wide field of view provided by the sighting apparatus 126. The field of view can be defined as the angle of an arc 160 whose end points lie on a radial line extending from the center of the front sight to an obstructing surface on the rear sight. The field of view for the three-dot iron sight 58 is essentially 180° because the front sight is on the same horizontal plane as the rear sights. In contrast, the field of view for the sighting apparatus 126 can be greater than 180°, depending upon the geometry of the rear sight 122. In some embodiments of the present invention, efforts were made to find the smallest rear sight 122 needed to index the front sight 118.

One example of a rear sight 122 that enabled a markedly increased field of view is shown in FIGS. 3-10. A base portion 162 of the rear sight 122 has a width 164 that is less than approximately 75% of a corresponding width 66 of the upper surface 16 of the firearm 10. In another example, the width 164 of the base portion 162 is between 25% and 75% of the corresponding width 66 of the upper surface 16 of the firearm 10. In yet another example, the sides of the rear sight 122 are tapered, forming a trapezoid that is wider at a base portion 162 than at a top portion 168. The resultant field of view may be in a range between 200° and 275°, for example. In the illustrated example, the field of view is 225°.

In quantitative terms, the field of view blocked by the three-dot iron sight 58 projects outward towards the target, increasing in size as distance to target increases. Accordingly, the field of view reclaimed by the sighting apparatus 126 (e.g., the shaded area) can have an increasingly beneficial effect as distance to target increases. In one calculation, the area opened up (e.g., shaded area) is approximately 0.10 inches high. At 10 feet, this projects to approximately 3 inches high. But at 25 yards, this projects to about 20 inches of additional viewing height, which may allow the user see the lower torso and arms of a hostile and ascertain whether the individual is drawing a weapon. In addition, the user has greatly expanded views to the right and left.

Figure 9:
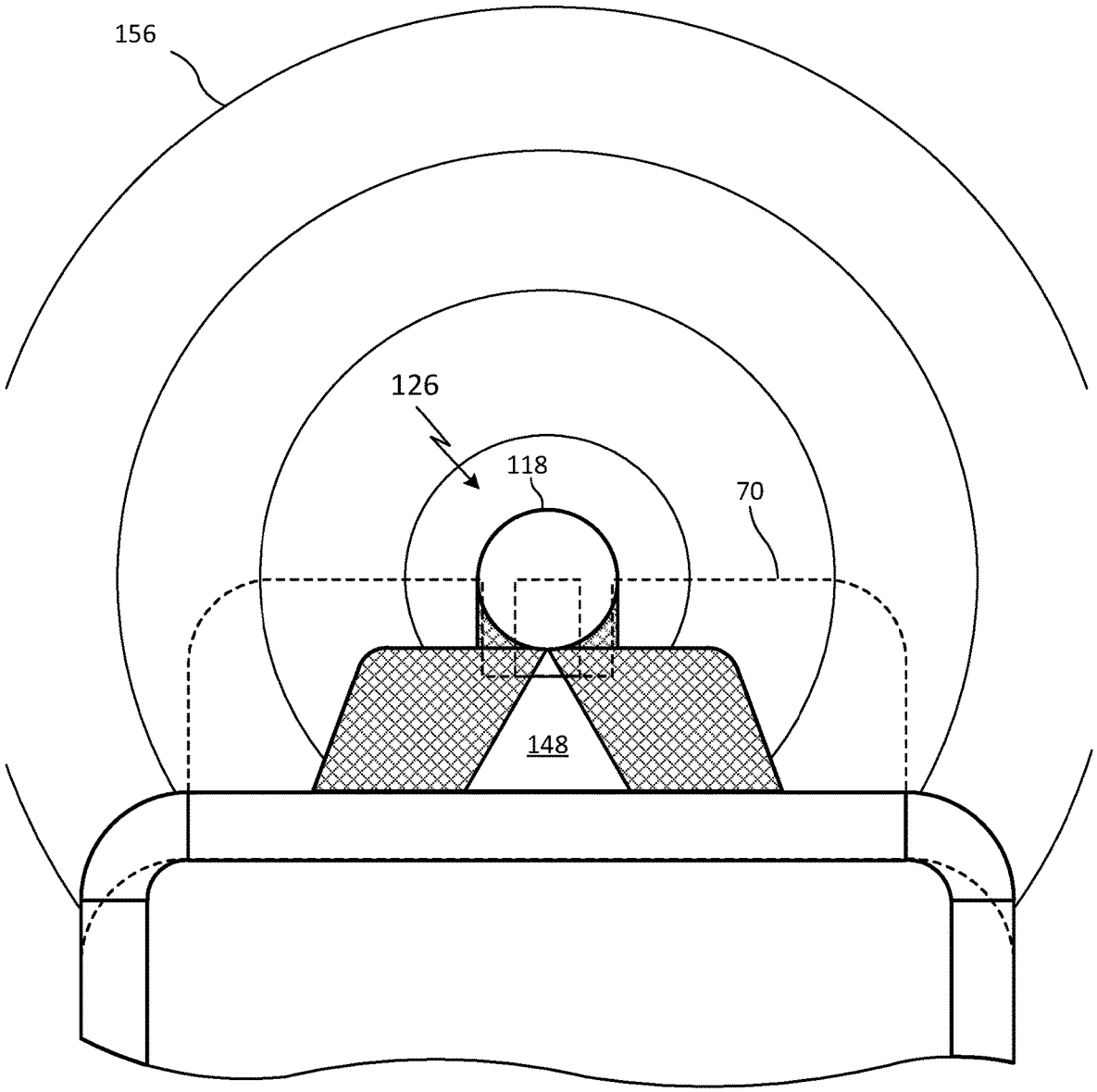
FIG. 9 depicts an enlarged view of the sighting apparatus and target overlaid with a prior-art competition iron sight.
Figure 10:
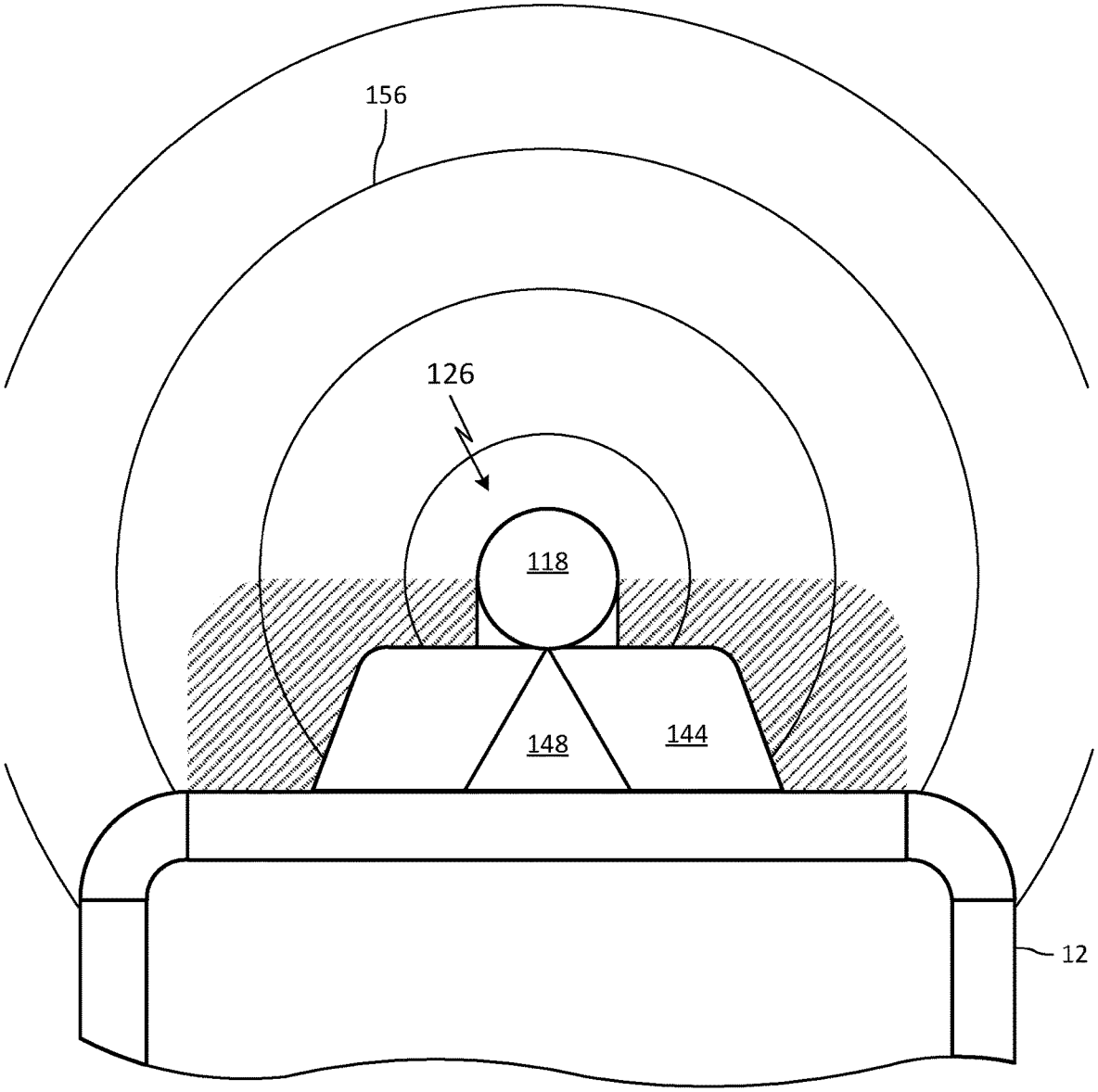
FIG. 10 depicts the sighting apparatus and target of FIG. 9, with the shaded region depicting the obstructed field of view from the competition iron sight.

FIG. 9 illustrates the sighting apparatus 126 and target 156 shown in FIG. 6, overlaid with a typical competition iron sight 70 (shown in dashed line), centered on the same target. The shaded region in FIG. 10 depicts the obstructed view from the competition iron sight 70 relative to the wide field of view provided by the sighting apparatus 126. The competition iron sight 70 is wider than a typical three-dot iron sight, and therefore obscures more lateral view.

In the illustrated embodiments, both the front sight 118 and the rear sight 122 are passive sights, requiring no electrical power. However, embodiments with active sights are contemplated without departing from the scope of the invention, in particular powered indexing elements.

Although embodiments of the sighting apparatus disclosed herein were described in reference to a pistol application, the invention is not so limited. It is contemplated that the sighting apparatus may also find application with shotguns, rifles, machine guns, revolvers, and muskets, for example, without departing from the scope of the invention.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

The invention claimed is:

1. A sighting apparatus for a firearm, comprising:

a front sight affixed to an upper surface at a front end of the firearm;

a rear sight affixed to the upper surface at an opposing rear end of the firearm, the rear sight comprising a main body and an indexing element positioned on and in visual contrast to a rear face of the main body, the positioning of the indexing element such that a topmost portion thereof aligns with an upper plane of the main body;

wherein the front sight is positioned on the upper surface of the firearm at an overall height greater than the rear sight, such that a height $H_{fs}$ from the upper surface of the firearm to a bottommost portion of the front sight is approximately the same as a rear site height $H_{rs}$ from the upper surface of the firearm to the upper plane of the rear sight.

2. The sighting apparatus according to claim 1, wherein the upper surface is a pistol slide.

3. The sighting apparatus according to claim 1, wherein the front sight, viewed from the rear end towards the front end, comprises a circular shape.

4. The sighting apparatus according to claim 3, wherein the front sight comprises fiber optic material.

5. The sighting apparatus according to claim 1, wherein a base portion of the rear sight main body comprises a width that is less than approximately 75 percent of a corresponding width of the upper surface of the firearm.

6. The sighting apparatus according to claim 5, wherein the width of the base portion is between 25 percent and 75 percent of the corresponding width of the upper surface of the firearm.

7. The sighting apparatus according to claim 1, wherein the main body of the rear sight, viewed from the rear end towards the front end, comprises a trapezoidal shape, wider at a base portion than at a top portion thereof.

8. The sighting apparatus according to claim 7, wherein the trapezoidal shape defines a field of view greater than 180 degrees.

9. The sighting apparatus according to claim 8, wherein the field of view is in a range between 200 and 275 degrees.

* * * * *